US006578245B1

(12) United States Patent
Chatterjee et al.

(10) Patent No.: US 6,578,245 B1
(45) Date of Patent: Jun. 17, 2003

(54) METHOD OF MAKING A PRINT HEAD

(75) Inventors: Dilip K. Chatterjee, Rochester, NY (US); Edward P. Furlani, Lancaster, NY (US); Syamal K. Ghosh, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/573,511

(22) Filed: May 18, 2000

Related U.S. Application Data

(62) Division of application No. 09/143,944, filed on Aug. 31, 1998, now Pat. No. 6,367,132.

(51) Int. Cl.[7] ..... H04R 17/00; B21D 53/76

(52) U.S. Cl. ..... 29/25.35; 29/890.1; 427/100; 427/96; 310/328; 310/331; 347/68; 347/71

(58) Field of Search ..... 29/25.35, 890.1, 29/846; 427/69, 100, 96, 419.3, 430.1; 252/62.9 R, 62.9 PZ; 310/328, 331, 332; 347/68, 71

(56) References Cited

U.S. PATENT DOCUMENTS 3,640,866 A * 2/1972 Nishida et al. ..... 252/62.9 PZ
3,862,046 A * 1/1975 Walker et al. ..... 252/62.9 PZ
4,615,848 A * 10/1986 Krueger et al. ..... 427/100 X
4,726,099 A * 2/1988 Card et al. ..... 29/25.35
4,990,584 A * 2/1991 Kishimoto et al. ... 252/62.9 PZ
5,266,964 A * 11/1993 Takahashi et al. ..... 29/25.35 X

FOREIGN PATENT DOCUMENTS

JP 56-161710 * 12/1981 ..... 29/25.35

* cited by examiner

*Primary Examiner*—A. Dexter Tugbang
(74) *Attorney, Agent, or Firm*—Clyde E. Bailey, Sr.

(57) ABSTRACT

A method of making a print head (100) includes forming a body (110) having a closed base (120) and independent fluid containment compartments (220) formed about the closed base (120). A substantially planar piezoelectric transducer (80) comprising a slab (60) of piezoelectric material provides a means of enclosing each of the independent fluid containment compartments (220). Each of the independent compartments has operably associated therewith one of a plurality of first electrodes (20) arranged on a first surface (62) of the slab (60) of piezoelectric material and a portion of a second electrode (22) arranged on an opposite second surface (64). By applying a voltage to the first and second surface electrodes (20, 22) in a predetermined manner induces an electric field in a portion of the slab (60) of piezoelectric material and thereby forces fluid composition through the independent fluid containment compartment (220).

6 Claims, 7 Drawing Sheets

METHOD OF MAKING A PRINT HEAD

CROSS REFERENCE TO RELATED APPLICATIONS

This application is a divisional of U.S. Ser. No. 09/143,944, now U.S. Pat. No. 6,367,132, filed Aug. 31, 1998, by Dilip K. Chatteijee, et al., and entitled "Method Of Making A Print Head."

This application is related to the following concurrently filed applications: (a) U.S. patent application Ser. No. 09/144,227 "Ceramic Ink Jet Printing Element" by Dilip K. Chatterjee, Edward P. Furlani, and Syamal K. Ghosh; and (b) U.S. patent application Ser. No. 09/144,122, for "Dual Actuated Printing Element" by Dilip K. Chatterjee, Edward P. Furlani, and Syamal K. Ghosh; and, reference is made to commonly assigned U.S. Pat. No. 5,900,274, issued May 4, 1999, entitled "Controlled Composition and Crystallographic Changes in Forming Functionally Gradient Piezoelectric Transducers" by Chatterjee et al; U.S. patent application Ser. No. 09/071,486, filed May 1, 1998, now abandoned, entitled "Functionally Gradient Piezoelectric Transducers" by Furlani et al; U.S. Pat. No. 6,013,311, issued Jan. 11, 2000, entitled "Using Morphological Changes to Make Piezoelectric Transducers", by Chatterjee et al; and U.S. patent application Ser. No. 09/120,995 filed Jul. 22, 1998, entitled "Piezoelectric Actuating Element For An Ink Jet Head And The Like", by Furlani et al, the disclosures of which are incorporated herein by reference.

FIELD OF THE INVENTION

The invention relates generally to the field of printing and, more particularly, to a method of making a print head that utilizes a functionally gradient piezoelectric element.

BACKGROUND OF THE INVENTION

Piezoelectric ink jet elements are used in a wide range of microfluidic printing devices. Conventional ink jet elements utilize piezoelectric transducers that comprise one or more uniformly polarized piezoelectric elements with attached surface electrodes. The three most common transducer configurations are multilayer ceramic, monomorph or bimorphs, and flextensional composite transducers. To activate a transducer, a voltage is applied across its electrodes thereby creating an electric field throughout the piezoelectric elements. This field induces a change in the geometry of the piezoelectric elements resulting in elongation, contraction, shear or combinations thereof. The induced geometric distortion of the elements can be used to implement motion or perform work. In particular, piezoelectric bimorph transducers that produce a bending motion, are commonly used in micropumping devices. However, a drawback of the conventional piezoelectric bimorph transducer is that two bonded piezoelectric elements are needed to implement the bending. These bimorph transducers are typically difficult and costly to manufacture for micropumping applications (in this application, the word micro means that the dimensions of the element range from 100 microns to 10 mm). Also, when multiple bonded elements are used, stress induced in the elements due to their constrained motion can damage or fracture an element due to abrupt changes in material properties and strain at material interfaces.

Therefore, a need persists for an ink jet head that overcomes the aforementioned problems associated with conventional ink jet apparatus.

SUMMARY OF THE INVENTION

It is, therefore, an object of the present invention to provide a method of making a print head that utilizes a novel piezoelectric element.

It is another object of the invention to provide a method that utilizes a slab of piezoelectric material having a functionally gradient d-coefficient selected so that the material changes its geometry in response to an electric field in the slab.

Yet another object of the invention is to provide a method that enables any one of a plurality of independent fluid containment compartment to be activated for channeling fluid.

It is a feature of the invention that the method of making a print head includes the step of providing a plurality of independent fluid containment compartments each having a piezoelectric transducer having a functionally gradient d-coefficient for activating the flow of fluid therethrough.

To accomplish the several objects and advantages of the invention, there is provided a method of making a print head, comprising the steps of:

(a) forming a body having a closed base and a plurality of open independent fluid containment compartments formed about the base, each compartment having at least one inlet orifice and at least one outlet orifice;

(b) providing a substantially planar piezoelectric transducer comprising a slab of piezoelectric material having a first surface and an opposing second surface for enclosing said open independent fluid containment compartments, said piezoelectric material being provided having a functionally gradient d-coefficient selected so that said slab changes geometry in response to an applied voltage which produces an electric field in the slab;

(c) providing a plurality of first electrodes and a second electrode;

(d) arranging each one of said plurality of first electrodes on said first surface of said slab of piezoelectric material and said second electrodes on said second surface;

(e) arranging said piezoelectric transducer on said open independent fluid containment compartment such that each one of said plurality of first electrodes and a portion of said second electrode are operably associated with each one of said plurality of independent fluid containment compartments;

(f) providing a source of fluid composition in fluid communications with each one of said inlet orifices of each one of said independent fluid containment compartments; said source being arranged for channeling said fluid composition through an inlet orifice of said at least one of said plurality of independent fluid containment compartments; and, (g) providing a source of power operably associated with each one of said first electrodes and said second electrode such that energizing any one of said plurality of first electrodes and said second electrode associated with any one of said independent fluid containment compartments enables said fluid composition to flow through said outlet orifice of one of said one independent fluid containment compartments.

An important advantage of the method of the present invention is that it provides for the utilization of a piezoelectric actuating element that comprises a single slab of piezoelectric material having a functionally gradient d-coefficient to implement droplet ejection, thereby eliminating the need for multilayered or composite piezoelectric structures. Moreover, a further advantage of the present method is that the slab of piezoelectric material provided for has a longer operational life span because it eliminates the stress induced fracturing that occurs in multilayered or composite piezoelectric transducers.

BRIEF DESCRIPTION OF THE DRAWINGS

The above and objects, features and advantages of the present invention will become apparent when taken in conjunction with the following description and drawings wherein identical reference numerals have been used, where possible, to designate identical features that are common to the figures, and wherein.

DETAILED DESCRIPTION OF THE INVENTION

Figure 1:
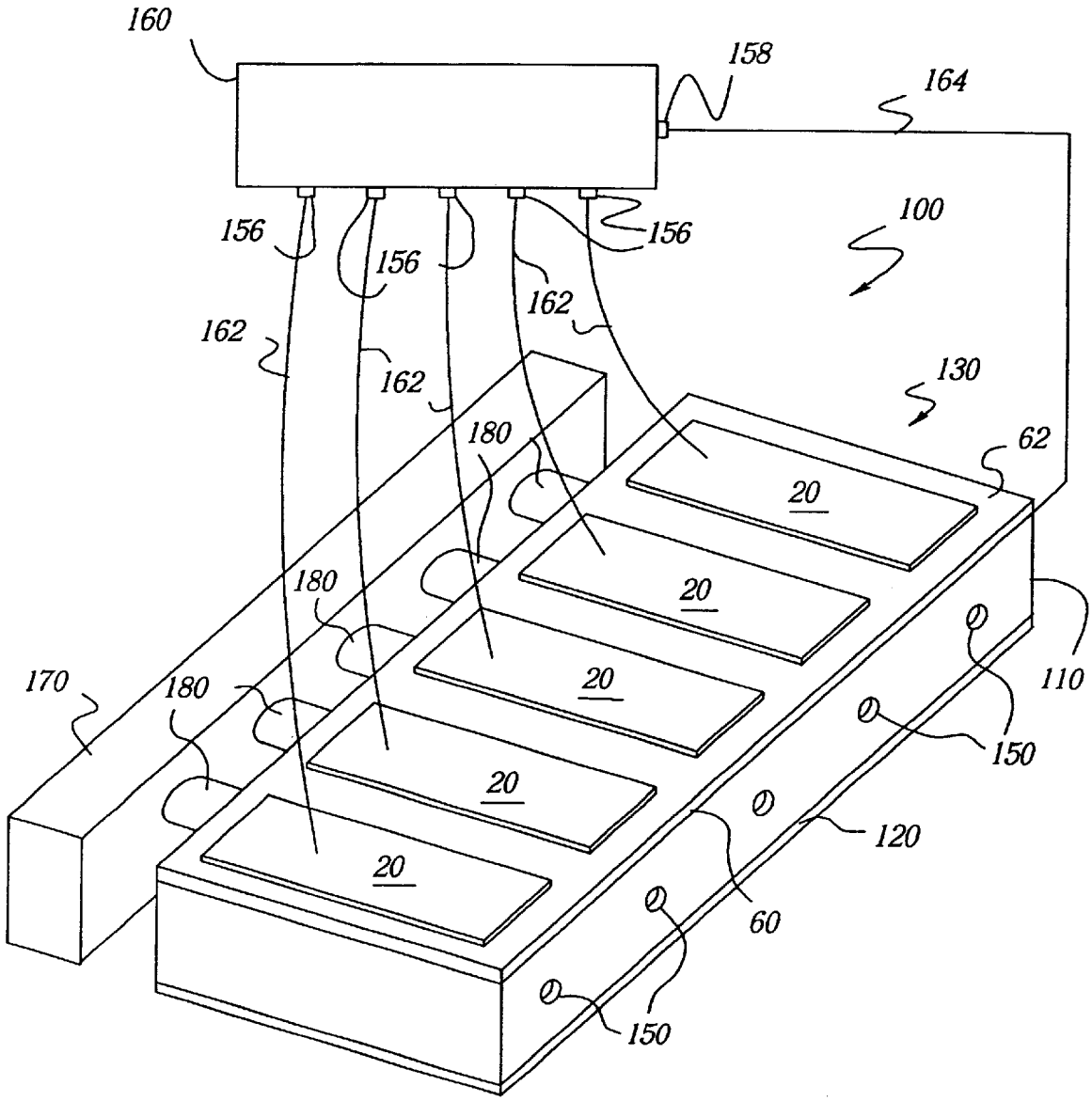
FIG. 1 is a perspective view of the print head of the invention.
Figure 2:
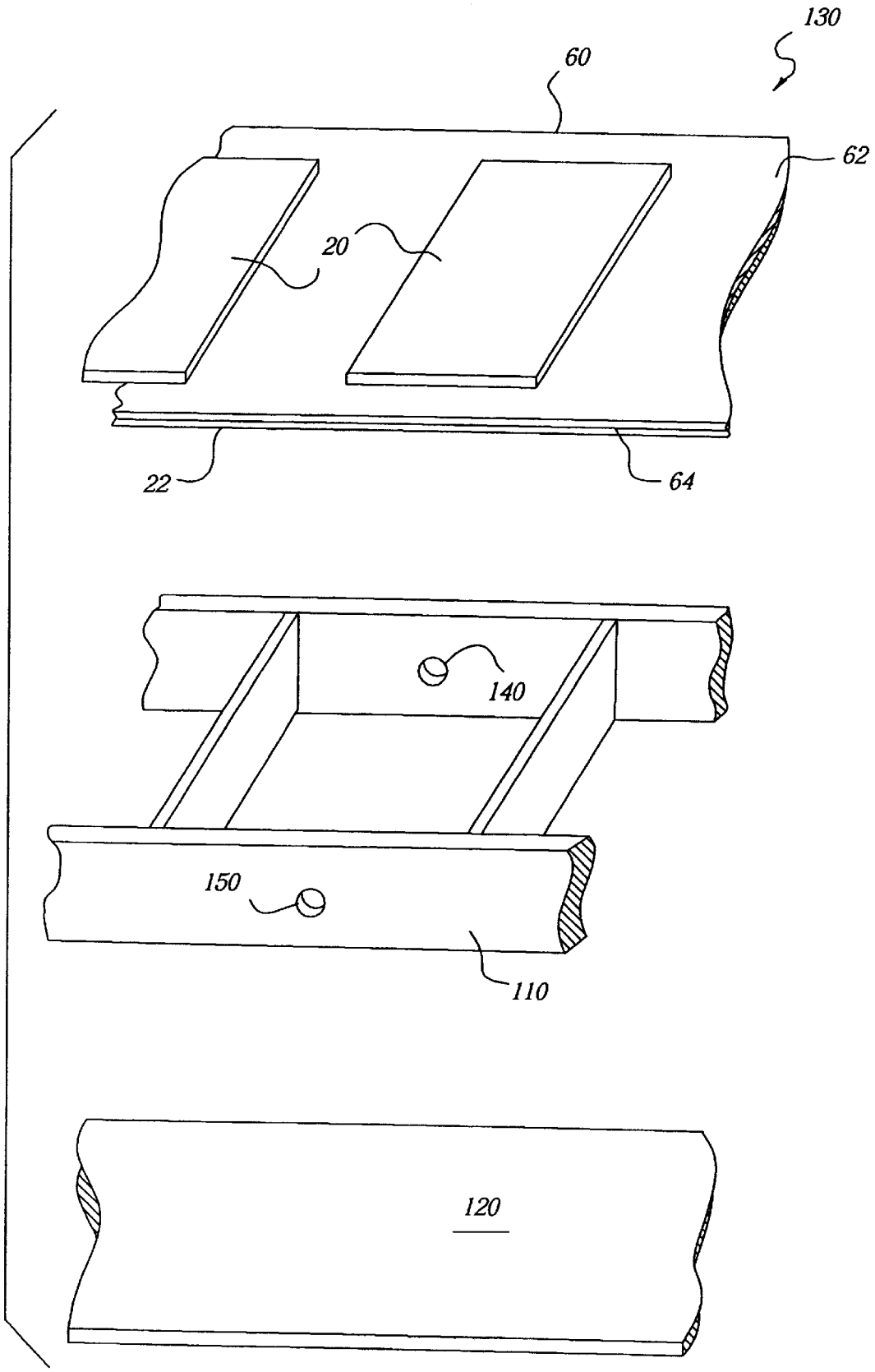
FIG. 2 is an exploded view of a portion of the print head of the invention.
Figure 9:
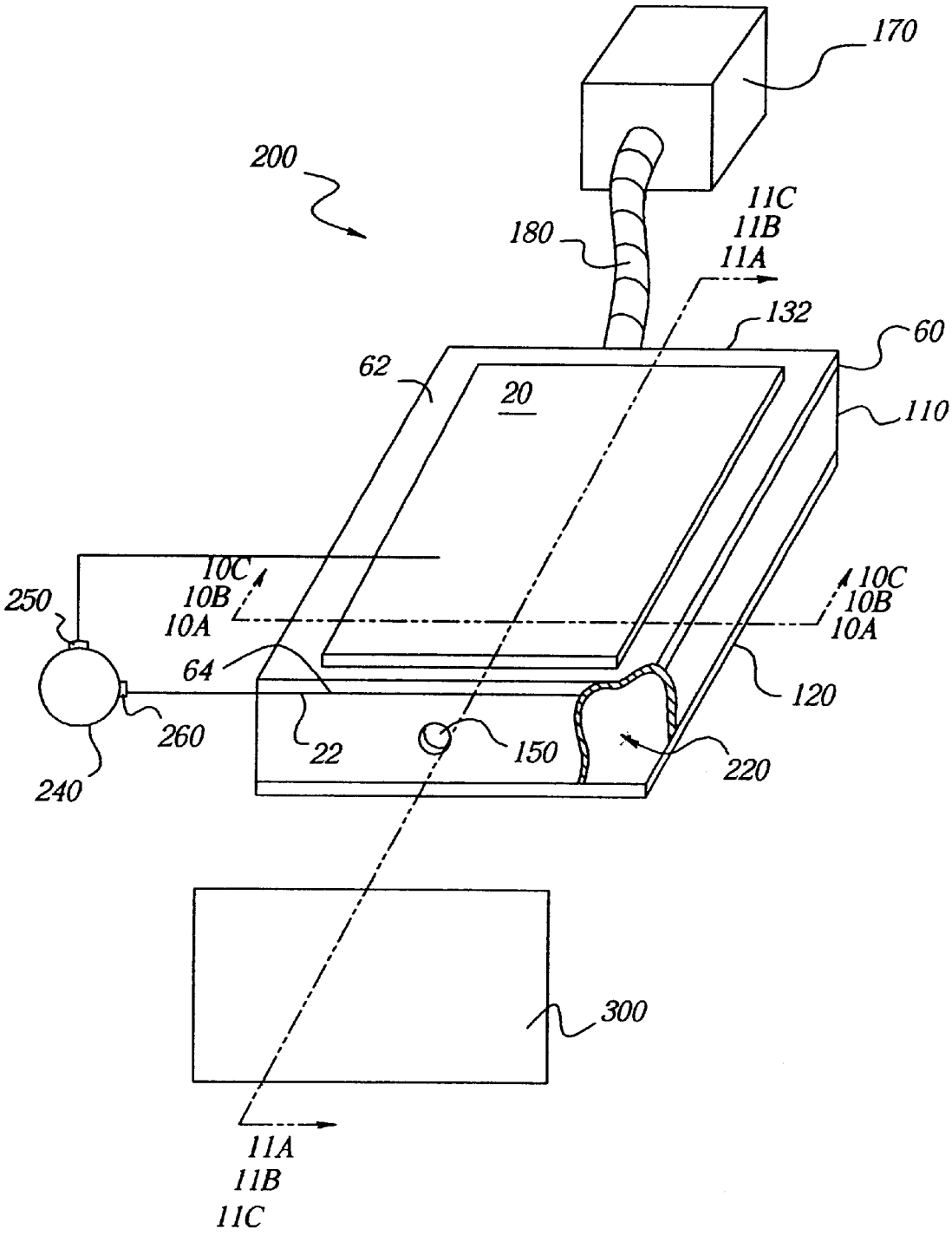
FIG. 9 is a perspective view of a single print element of the invention with a partial cut away section illustrating the internal fluid containment compartment.

Turning now to the drawings, and particularly to FIGS. 1, 2, and 9, the print head 100 of the present invention is illustrated. As depicted in FIGS. 1 and 2, print head 100 comprises a body 110, a base 120, and a piezoelectric actuating element 130. The body 110 has a plurality of separate independent compartments, each defining a print element or head 100 (discussed further below), and each print head 100 having an inlet orifice 140 and outlet orifice 150. Base 120 and piezoelectric actuating element 130 are fixedly attached to the body 110 in such a way so as to form a contiguous array of individual print elements 200 (see FIG. 9).

According to FIGS. 1 and 2, piezoelectric actuating element 130 comprises a slab 60 of piezoelectric material having opposed first and second surfaces 62 and 64. A plurality of spaced first surface electrodes 20 is mounted on the first surface 62 of slab 60 of piezoelectric material. A second surface electrode 22 is mounted on opposed second surface 64 of slab 60 of piezoelectric material and extends substantially lengthwise along the second surface 64. Each one of the plurality of first surface electrodes 20 is operably associated with one of the plurality of fluid containment compartments 220 (see FIG. 9). As illustrated in FIG. 1, power source 160, with a plurality of first terminals 156, connects to the plurality of first surface electrodes 20 via wires 162. A second terminal 158 of power source 160 is electrically connected to the second surface electrode 22 via wire 164. The power source 160 can impart a voltage of a specified polarity and magnitude to any one of the plurality of first surface electrodes 20. Moreover, power source 160 may impart a predetermined voltage simultaneously to any number of the plurality of first surface electrodes 20 and a different voltage to the second surface electrodes 22 of piezoelectric actuating elements 130.

Referring again to FIGS. 1 and 2, ink reservoir 170 is connected via fluid conduits 180 to inlet orifices 140 for supplying ink to the print head 100. Print head 100 is adapted to receive ink from ink reservoir 170 which is in fluid communication with the inlet orifices 140, and eject droplets of the ink onto a receiver (not shown) to form an image as will be described.

Body 110, having a plurality of containment compartments 220, of the printing element 100 can be manufactured by injection molding of plastics or ceramic composite materials, as described below. Advantages of having a body 110 made of such materials are that they are non-corrosive to the various ink compositions contained therein and they have sufficient flexural properties to squeeze ink out of the ink compartments with the aid of piezoelectric actuating element 130. Those skilled in the art will appreciate that injection molding of plastics and ceramics to form intricate bodies is known in the art. Hence, during fabrication, inlet and outlet orifices 140, 150 of the body 110 can be formed either during the injection molding process or after the injection molding process by either mechanical drilling or laser assisted drilling. The base 120 of the body 110 can be made separately utilizing a plastic sheet and then attaching the base 120 to the body 110 utilizing an appropriate adhesive. Alternatively, base 120 and body 110 can be made together by an injection molding process.

Figure 6:
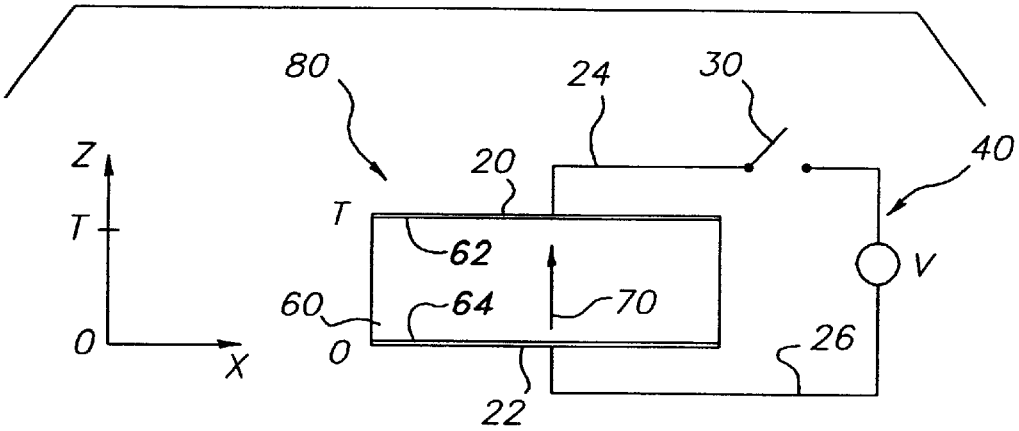
FIG. 6 is a section view along line 6—6 of FIG. 3 illustrating the piezoelectric transducer before activation.
Figure 7:
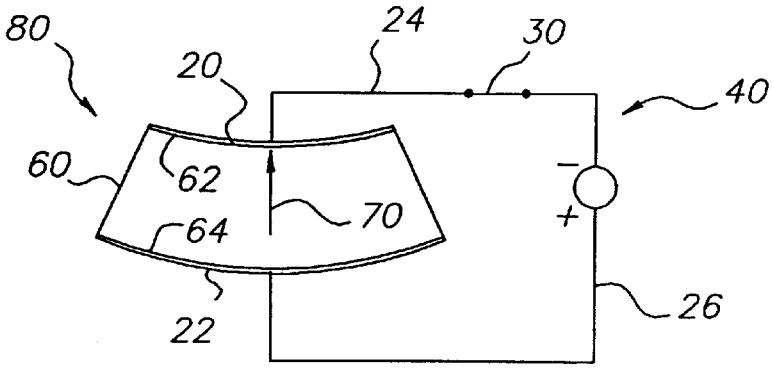
FIG. 7 is a section view taken along line 7—7 of FIG. 3 illustrating the piezoelectric transducer after activation.
Figure 8:
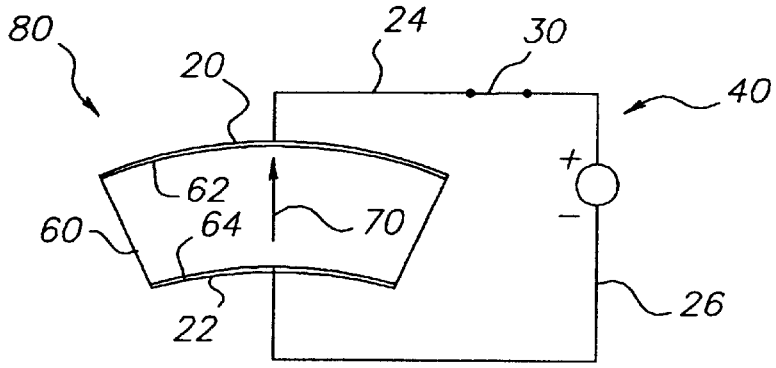
FIG. 8 is a section view taken along line 8—8 of FIG. 3 illustrating the piezoelectric transducer after activation but under a opposite polarity compared to FIG. 7.

Depicted in FIGS. 6–8, piezoelectric actuating element 130 is essentially a slab 60 of piezoelectric material having opposed first and second surfaces 62, 64. Slab 60 is preferably made from ferroelectric materials such as PZT, PLZT, $LiNbO_3$, $LiTaO_3$, $KNbO_3$, $BaTiO_3$ or from a mixture of these materials, most preferred being PZT (lead-zirconium-titanates). Skilled artisans will appreciate that the gradient in piezoelectric properties in these materials can be achieved either by varying the chemical composition of individual species, by changing the crystallographic nature of the piezoelectric phases, by modifying the morphological nature of the phases, or by combination of all the three procedures. The preferred direction of change in gradient of piezoelectric properties, particularly the d-coefficients in this present invention, is the thickness direction. The d-coefficients are constants of proportionality that relate the stresses induced in piezoelectric material to the electric field applied therein. The most preferred piezoelectric material for construction of print head 100 of the invention is PZT (lead-zirconium-titanates). These functionally gradient piezoelements are manufactured either by sequential dip coating, or by tape casting, or by cold pressing, or by injection molding, or by extrusion and subsequently sintering.

Referring again to FIG. 2, first and second surface electrodes 20, 22 are arranged on the first and second opposed surfaces 62, 64, respectively, of the functionally gradient piezoelectric actuating element 130 in predetermined locations, preferably above the ink compartments. First and second surface electrodes 20, 22 may be affixed to their respective surfaces either by screen printing, or by chemical vapor deposition, or by physical vapor deposition of highly conducting elements such as gold, silver, palladium, or gold-palladium alloy. Preferably, after the first and second surface electrodes 20, 22 are affixed to the surfaces, piezoelectric actuating element 130 is then fixedly attached to the body 110 using some sort of adhesive material.

In a most preferred embodiment of this invention, the body 110 and the base 120 of the print head 100 can be made in conjunction by adopting injection molding of ceramic or ceramic composite materials such as tetragonal zirconia alloy or zirconia-alumina composites. These materials have sufficient toughness, corrosion resistance and wear and abrasion resistance (pigment particles in ink causes wear and abrasion in the ink compartment and outlet orifices) to be ideal candidates for print element 200. In this embodiment, body 110 and the base 120 are made in the green ceramic form in one single step injection molding process using compounded zirconia alloy or compounded zirconia-alumina composites. The inlet and outlet orifices 140, 150 can be made in the body 110 either during the injection molding process or in a secondary step wherein a sacrificial member (not shown) is inserted at the desired locations of the green bodies. These sacrificial members (not shown) degenerates during the later sintering step. The piezoelectric actuating elements 130 are made by the methods described above. However, before sintering the green piezoelements, the electrodes are formed in desired locations of the elements adopting the methods described above. The next step in the manufacturing process is the alignment and positioning of the green ink jet body 110 with base 120 and the green piezoelectric actuating element 130 assemblage and sintering of the assemblage. During the sintering process, the electroded piezoelectric element and the body (with base) of the head bond together to form the print head 100. The sacrificial elements (not shown), which were used to form the orifices degenerate during the sintering process forming the inlet and outlet orifices 140, 150.

Figure 3:
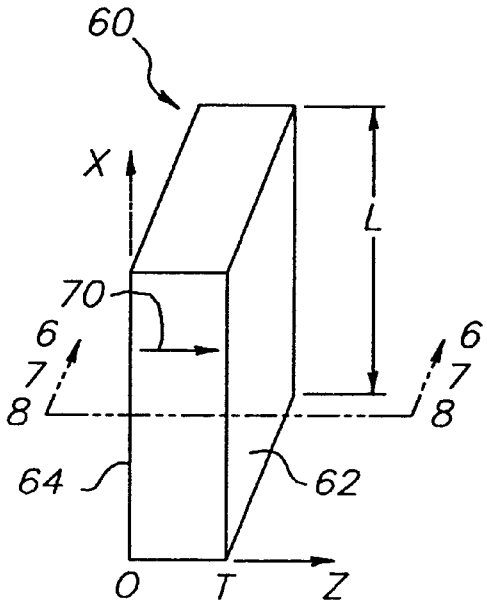
FIG. 3 is a perspective view of a slab of piezoelectric material with a functionally gradient $d_{31}$ coefficient.

Referring to FIG. 3, a perspective view is shown of the slab 60 of piezoelectric material with a functionally gradient $d_{31}$ coefficient. As indicated, slab 60 of piezoelectric material has opposed first and second surfaces 62 and 64. The width of the slab 60 of piezoelectric material is denoted by (T) and runs perpendicular to the first and second surfaces 62 and 64, as shown in FIG. 3. The length of slab 60 of piezoelectric material is denoted by (L) and runs parallel to the first and second surfaces 62 and 64, as also shown in FIG. 3. Slab 60 of piezoelectric material is poled perpendicularly to the first and second surfaces 62 and 64, as indicated by polarization vector 70.

Figure 4:
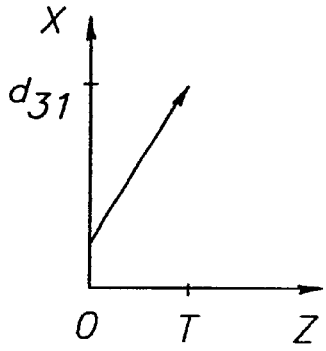
FIG. 4 is a plot of the piezoelectric $d_{31}$ coefficient across the width (T) of the slab of piezoelectric material of FIG. 3.
Figure 5:
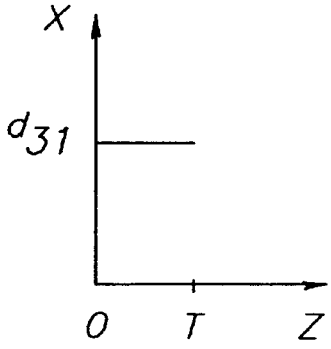
FIG. 5 is a plot of piezoelectric $d_{31}$ coefficient across the width (T) of a conventional piezoelectric bimorph transducer element, respectively.

Skilled artisans will appreciate that in conventional piezoelectric transducers the piezoelectric "d"-coefficients are constant throughout the slab 60 of piezoelectric material. Moreover, the magnitude of the induced sheer and strain are related to these "d"-coefficients via the constitutive relation as is well known. However, slab 60 of piezoelectric material used in the print head 100 of the invention is fabricated in a novel manner so that its piezoelectric properties vary in a prescribed fashion across its width as described below. The $d_{31}$ coefficient varies along a first direction perpendicular to the first surface 62 and the second surface 64, and decreases from the first surface 62 to the second surface 64, as shown in FIG. 4. This is in contrast to the uniform or constant spatial dependency of the $d_{31}$ coefficient in conventional piezoelectric elements, illustrated in FIG. 5.

In order to form the preferred slab 60 of piezoelectric material having a piezoelectric $d_{31}$ coefficient that varies in this fashion, the following method may be used. A piezoelectric block is coated with a first layer of piezoelectric material with a different composition than the block onto a surface of the block. Sequential coatings of one or more layers of piezoelectric material are then formed on the first layer and subsequent layers with different compositions of piezoelectric material. In this way, the piezoelectric element is formed which has a functionally gradient composition which varies along the width of the piezoelectric element, as shown in FIG. 4.

Preferably, the piezoelectric materials used for forming the piezoelectric element is selected from the group consisting of PZT, PLZT, $LiNbO_3$, $LiTaO_3$, $KNbO_3$, or $BaTiO_3$. Most preferred in this group is PZT. For a more detailed description of the method, see commonly assigned U.S. patent application Ser. Nos. 09/071,485, filed May 1, 1998, to Chatteijee et al; 09/071,486, filed May 1, 1998, to Furlani et al; and, 09/093,268, filed Jun. 8, 1998, to Chatteijee et al, hereby incorporated herein by reference.

Referring now to FIGS. 6–8, the piezoelectric transducer 80 is illustrated comprising slab 60 of piezoelectric material in the inactivated state, a first bending state and a second bending state, respectively. As previously mentioned, piezoelectric transducer 80 comprises a slab 60 of piezoelectric material with polarization vector 70, and first and second surface electrodes 20 and 22 attached to first and second surfaces 62 and 64, respectively. First and second surface electrodes 20 and 22 are connected to wires 24 and 26, respectively. Wire 24 is connected to a switch 30 that, in turn, is connected to a first terminal of voltage source 40. Wire 26 is connected to the second terminal of voltage source 40 as shown.

According to FIG. 6, the piezoelectric transducer 80 is shown with switch 30 open. Thus there is no voltage across the piezoelectric transducer 80 and it remains unactivated.

Referring now to FIG. 7, the piezoelectric transducer 80 is shown with switch 30 closed. In this case, the voltage (V) of voltage source 40 is impressed across the piezoelectric transducer 80 with the negative and positive terminals of the voltage source 40 electrically connected to the first and second surface electrodes 20 and 22, respectively. Thus, the first surface electrode 20 is at a lower voltage than the second surface electrode 22. This potential difference creates an electric field through the slab 60 of piezoelectric material causing it to contract in length parallel to its first and second surfaces 62 and 64, respectively and perpendicular to polarization vector 70. Specifically the change in length (in this case contraction) is given by $S(z)=-(d_{31}(z)\ V/T)\times L$ as is well known. Since the functional dependence of the piezoelectric coefficient $d_{31}(z)$ increases with z as shown in FIG. 4, the lateral contraction S(z) of the slab 60 of piezoelectric material decreases in magnitude from the first surface 62 to the second surface 64. Therefore, when the first surface electrode 20 is at a lower voltage than the second surface electrode 22, the slab 60 of piezoelectric material distorts into a first bending state as shown. It is important to note that the piezoelectric transducer 80 requires only one slab 60 of piezoelectric material as compared to two or more elements for the prior art bimorph transducer (not shown).

According to FIG. 8, the piezoelectric transducer 80 is shown with switch 30 closed. In this case, the voltage V of voltage source 40 is impressed across the piezoelectric transducer 80 with positive and negative terminals of the voltage source 40 electrically connected to the first and second surface electrodes 20 and 22, respectively. Thus, the first surface electrode 20 is at a higher voltage than the second surface electrode 22. This potential difference creates an electric field through the slab 60 of piezoelectric material causing it to expand in length parallel to its first and second surfaces 62 and 64, respectively and perpendicular to polarization vector 70. Specifically, we define S(z) to be the change in length (in this case expansion) in the x (parallel or lateral) direction noting that this expansion varies as a function of z. The thickness of the piezoelectric actuating element 130 is given by T as shown in FIG. 6, and therefore $S(z)=(d_{31}(z)\ V/T)\times L$ as is well known. The functional dependence of the piezoelectric coefficient $d_{31}(z)$ increases with z as shown in FIG. 4. Thus, the lateral expansion S(z) of the slab 60 of piezoelectric material decreases in magnitude from the first surface 62 to the second surface 64. Therefore, when the first surface electrode 20 is at a higher potential than the second surface electrode 22, the slab 60 of piezoelectric material distorts into a second bending state as shown.

Referring again to FIG. 9, a perspective is shown of one of the contiguous array of print elements 200 of the invention. In this embodiment, the print element 200 comprises a body 110, a base 120, and a piezoelectric actuator 132. The base 120 and piezoelectric actuator 132 are fixedly attached to the body 110 as shown, thereby forming a fluid containment compartment 220 that is shown in a partial cutaway view. As discussed previously, body 110 has an inlet orifice 140 (FIG. 2) and outlet orifice 150. Piezoelectric actuator 132 is shown comprising slab 60 of piezoelectric material with opposed first and second surfaces 62 and 64. As is understood, first surface electrode 20 is mounted on the first surface 62 of slab 60 of piezoelectric material and a second surface electrode 22 is mounted on the second surface 64 of slab 60 of piezoelectric material. Moreover, power source 240 is depicted having first and second terminals 250, 260 that are connected to the first and second surface electrodes 20 and 22, respectively. An ink reservoir 170 is connected via fluid conduit 180 to inlet orifice 140 (FIG. 2) for supplying ink to the fluid containment compartment 220 of the print element 200. A receiver 300 is positioned in front of the outlet orifice 150 for receiving ink drops 290 (as shown in FIGS. 11B and 11C) ejected from the print element 200 as will be described.

Figure 10A:
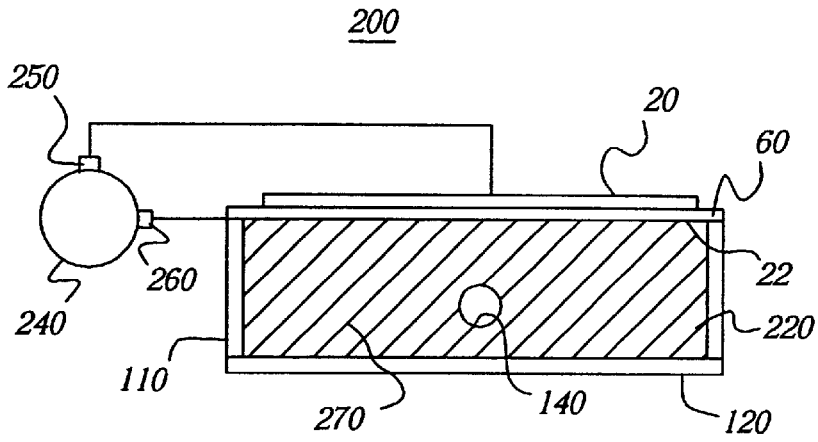
FIGS. 10A, 10B and 10C are section views of a print element taken along line 10A—10A, 10B—10B, 10C—10C, respectively, of FIG. 9 showing the print element in an unactivated, drop ejection, and ink refill state, respectively; and, FIGS. 11A, 11B and 11C are section views of a print element taken along line 11A—11A, 11B—11B, 11C—11C, respectively, of FIG. 9 showing the print element in an unactivated, drop ejection, and ink refill state, respectively.
Figure 10B:
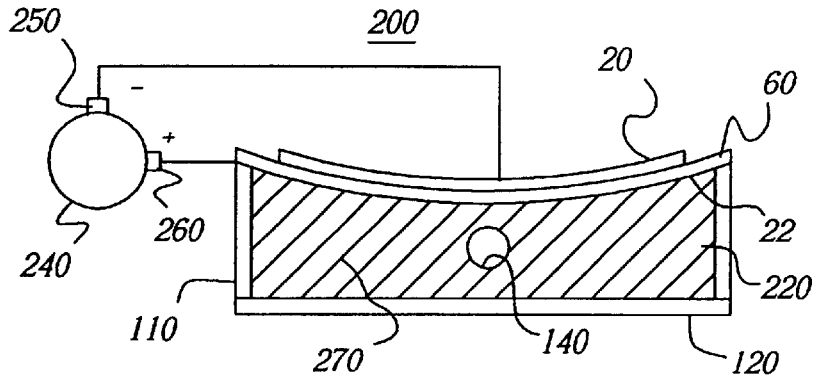
Figure 10C:
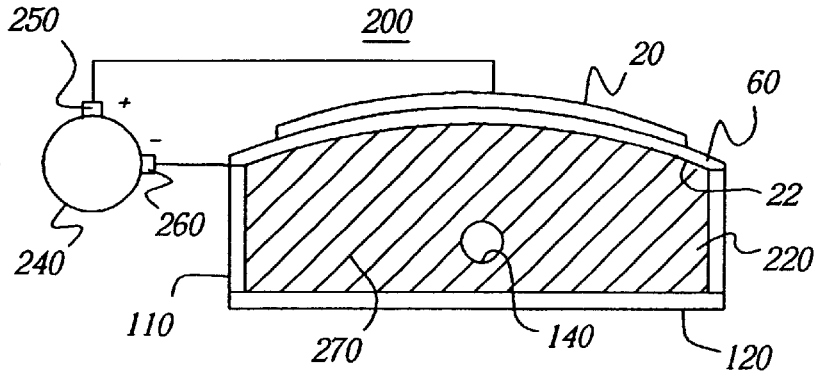
Figure 11A:
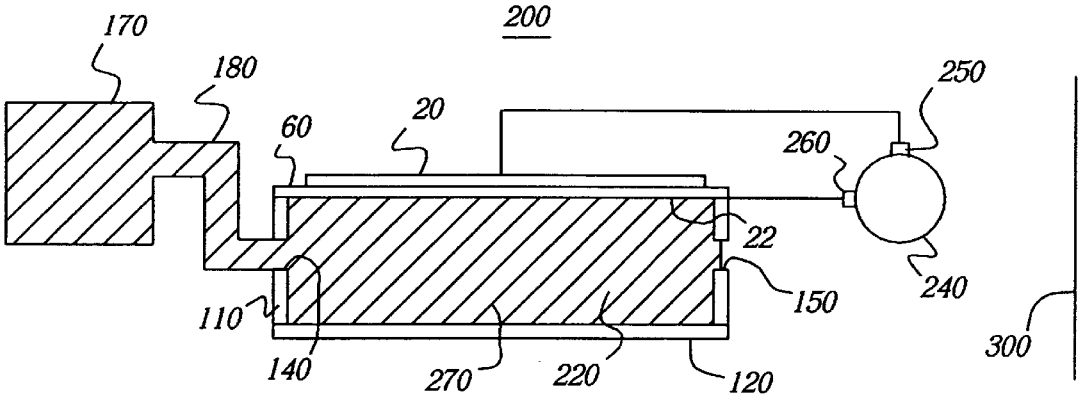
Figure 11B:
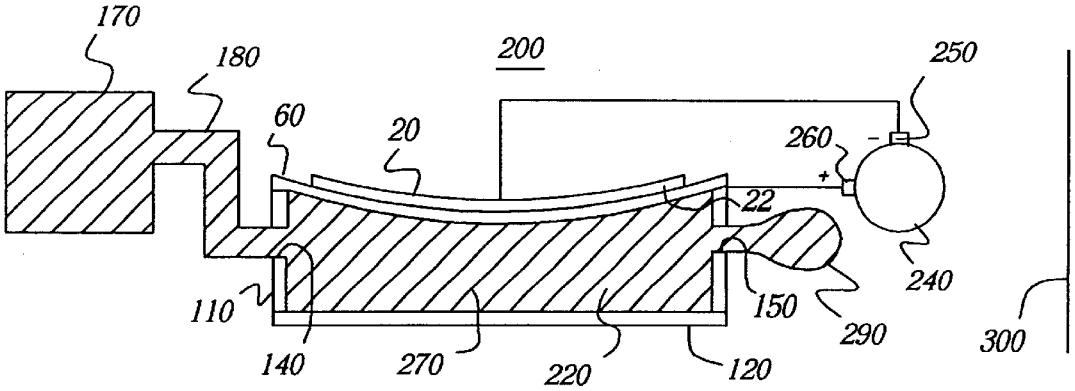
Figure 11C:
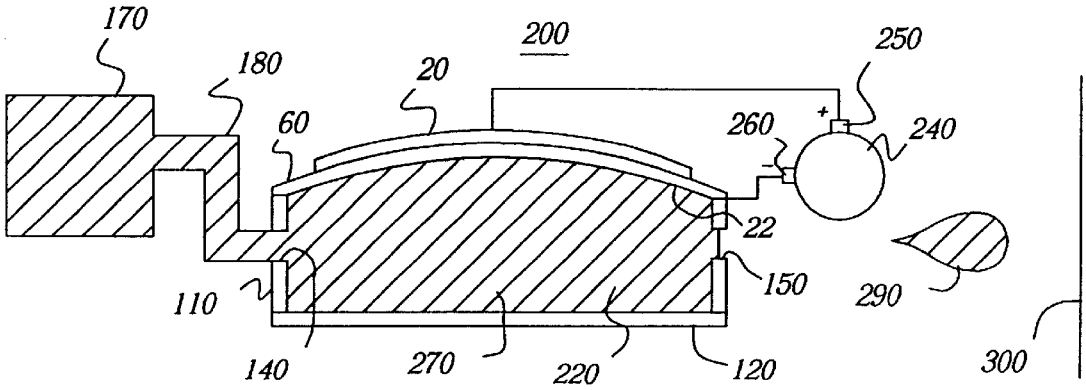

Referring now to FIGS. 10A, 10B, and 10C, and FIGS. 11A, 11B, and 11C, section views are shown of print element 200 taken along lines 10A—10A, 10B—10B, 10C—10C, and 11A—11A, 11B—11B, 11C—11C of FIG. 9, respectively. The ink in the fluid containment compartment 220 is indicated by the slanted lines 270. FIGS. 10A and 11A show the print element 200 in an unactivated state. FIGS. 10B and 11B show the print element 200 during ink drop formation and ejection, and FIGS. 10C and 11C show the print element 200 during the ink refill stage.

According to FIGS. 10A and 11A, when the power source 240 is off, there is of course no voltage being applied to the first or second terminals 250 and 260. Therefore, there exists no potential difference between the first and second surface electrodes 20 and 22 and the print element 200 is inactive.

According to FIGS. 10B and 11B, to pump a drop of ink 290 out of the fluid containment compartment 220 through the outlet orifice 150, power source 240 provides a negative voltage to first terminal 250 and a positive voltage to second terminal 260. Thus, the first surface electrode 20 is at a lower voltage than the second surface electrode 22. This creates an electric field through the slab 60 of piezoelectric material causing it to contract in length parallel to the first and second surface electrodes 20 and 22, as discussed above. Since the functional dependence of the piezoelectric coefficient $d_{31}(z)$ increases with (z) as shown in FIG. 4, the lateral contraction of the slab 60 of piezoelectric material decreases in magnitude from the first surface electrode 20 to the second surface electrode 22, thereby causing the slab 60 of piezoelectric material to deform into a first bending state as shown in FIG. 7. This, in turn, decreases the free volume of the fluid containment compartment 220 thereby increasing the pressure to such a level that a drop of ink 290 is ejected out through outlet orifice 150 and ultimately onto a receiver 300.

With reference to FIGS. 10C and 11C, to draw ink into the fluid containment compartment 220 from the ink reservoir 170, the power source 240 provides a positive voltage to first terminal 250 and a negative voltage to second terminal 260. Thus, the first surface electrode 20 is at a higher voltage than the second surface electrode 22. This potential difference creates an electric field through the slab 60 of piezoelectric material causing it to expand in length parallel to the first and second surface electrodes 20 and 22 as discussed above. Since the functional dependence of the piezoelectric coefficient $d_{31}(z)$ increases with (z) as shown in FIG. 4, the lateral expansion of the slab 60 of piezoelectric material decreases in magnitude from the first surface electrode 20 to the second surface electrode 22, thereby causing the slab 60 of piezoelectric material to deform into a second bending state as shown in FIG. 8. This, in turn, increases the free volume of the fluid containment compartment 220 thereby decreasing the pressure in the fluid containment compartment 220 so that it is less than in the ink reservoir 170. Under this condition, ink flows from the ink reservoir 170 via the fluid conduit 180, through the inlet orifice 140, into the fluid containment compartment 220.

The operation of the print head 100 can now be understood via reference to FIGS. 1, 2, 9, 10A—10C, and 11A—11C. To eject a drop of ink 290 out of one of the plurality of fluid containment compartments 220, the power source 160 simultaneously imparts a voltage to the first surface electrode 20 that is operably associated with the respective fluid containment compartment 220, and a different voltage to the second surface electrode 22 such that the respective first surface electrode 20 is at a lower voltage than the second surface electrode 22. This creates an electric field through a portion of the slab 60 of piezoelectric material between the respective first surface electrode 20 and a portion of the second surface electrode 22. As a result, slab 60 of piezoelectric material contracts in length parallel to the respective first surface electrode 20 and second surface electrode 22, as discussed above. Since the functional dependence of the piezoelectric coefficient $d_{31}(z)$ increases with (z) as shown in FIG. 4, the lateral contraction of the portion of the slab 60 of piezoelectric material between the respective first surface electrode 20 and the second surface electrode 22 decreases in magnitude from the respective first surface electrode 20 to the second surface electrode 22, thereby causing the portion of the slab 60 of piezoelectric material between the respective first surface electrode 20 and the second surface electrode 22 to deform into a first bending state as shown in FIG. 7. This, in turn, decreases the free volume of the respective fluid containment compartment 220. Simultaneously, the pressure of the ink in the respective fluid containment compartment 220 increases to such a level that a drop of ink 290 is ejected out through outlet orifice 150 of the respective fluid containment compartment 220, and ultimately onto a receiver 300.

Referring again to FIGS. 1 and 9 to initiate the flow of ink into one of the plurality of fluid containment compartments 220 of the print head 100 from ink reservoir 170, power source 160 is activated to impart a voltage to one of the plurality of first surface electrodes 20 that is operably associated with a specified fluid containment compartment 220. Simultaneously, a different voltage is imparted to the second surface electrode 22 by power source 160, such that the respective first surface electrode 20 is at a higher voltage than the second surface electrode 22. This creates an electric field through a portion of slab 60 of piezoelectric material between the first surface electrode 20 and a portion of the second surface electrode 22. As a result of the electric field, slab 60 of piezoelectric material is caused to expand in length parallel to the respective first surface electrode 20 and second surface electrode 22, as discussed above. Since the functional dependence of the piezoelectric coefficient $d_{31}(z)$ increases with (z) as shown in FIG. 4, the lateral expansion of the portion of the slab 60 of piezoelectric material between the respective first surface electrode 20 and the second surface electrode 22 increases in magnitude from the respective first surface electrode 20 to the second surface electrode 22, thereby causing the portion of the slab 60 of piezoelectric material between the respective first surface electrode 20 and the second surface electrode 22 to deform into a second bending state as shown in FIG. 7. This, in turn, increases the free volume of the respective fluid containment compartment 220 thereby decreasing the pressure in the respective fluid containment compartment 220 so that it is less than in the ink reservoir 170. Under this condition, ink flows from the ink reservoir 170 via the fluid conduit 180, through the inlet orifice 140, into the respective fluid containment compartment 220.

Therefore, the invention has been described with reference to a preferred embodiment. However, it will be appreciated that variations and modifications can be effected by a person of ordinary skill in the art without departing from the scope of the invention.

PARTS LIST

20 first surface electrode
22 second surface electrode
24 wire
26 wire
30 switch
40 voltage source
60 slab of piezoelectric material
62 first surface
64 second surface
70 polarization vector
80 piezoelectric transducer
100 print head
110 body
120 base
130 piezoelectric actuating element
132 piezoelectric actuator
140 inlet orifice
150 outlet orifice
156 first terminals
158 second terminal
160 power source
162 wires
164 wire
170 ink reservoir
180 fluid conduit
200 print element
220 fluid containment compartment
240 power source
250 first terminal
260 second terminal
270 slanted lines
290 drop or droplets of ink
300 receiver

What is claimed is:

1. Method of making a print head, comprising the steps of:

(a) forming a body having a closed base and a plurality of open independent fluid containment compartments formed about the base, each compartment having at least one inlet orifice and at least one outlet orifice;

(b) providing a substantially planar piezoelectric transducer comprising a slab of piezoelectric material having a first surface and an opposing second surface for enclosing said open independent fluid containment compartments, said piezoelectric material being provided having a functionally gradient d-coefficient selected so that said slab bends in response to an applied voltage which produces an electric field in the slab;

(c) providing a plurality of first electrodes and a second electrode;

(d) screen printing in a single layer each one of said plurality of first electrodes on said first surface of said slab of piezoelectric material and said second electrode on said second surface;

(e) arranging said piezoelectric transducer on said open independent fluid containment compartment such that each one of said plurality of first electrodes and a portion of said second electrode, each being arranged in said single layer on said first surface and said second surface of said piezoelectric material, respectively, are operably associated with each one of said plurality of independent fluid containment compartments;

(f) providing a source of fluid composition in fluid communications with each one of said inlet orifices of each one of said independent fluid containment compartments; said source being arranged for channeling said fluid composition through an inlet orifice of said at least one of said plurality of independent fluid containment compartments; and, (g) providing a source of power operably associated with each one of said first electrodes and said second electrode such that energizing any one of said plurality of first electrodes and said second electrode associated with any one of said independent fluid containment compartments enables said fluid composition to flow through said outlet orifice of one of said one independent fluid containment compartments.

2. The method recited in claim 1 wherein said step of providing a substantially planar piezoelectric transducer comprising a slab further includes the step of sequential dip coating said slab in any one of said materials to effect a compositional change in said slab from one end to another.

3. The method recited in claim 1 wherein said step of providing a substantially planar piezoelectric transducer comprising a slab further includes the step of tape casting said slab in any one of said materials to effect a compositional change in said slab from one end to another.

4. The method recited in claim 1 wherein said step of providing a substantially planar piezoelectric transducer comprising a slab further includes the step of cold pressing said slab in any one of said materials to effect a compositional change in said slab from one end to another.

5. The method recited in claim 1 wherein said step of providing a substantially planar piezoelectric transducer comprising a slab further includes the step of injection molding said slab in any one of said materials to effect a compositional change in said slab from one end to another.

6. The method recited in claim 1 wherein said step of providing a substantially planar piezoelectric transducer comprising a slab further includes the step of extruding said slab in any one of said materials to effect a compositional change in said slab from one end to another.

* * * * *